United States Patent [19]

Micklethwaite

[11] Patent Number: 4,626,864

[45] Date of Patent: Dec. 2, 1986

[54] MOTORIZED ANTENNA MOUNT FOR SATELLITE DISH

[75] Inventor: Ian W. Micklethwaite, Terra Cotta, Canada

[73] Assignee: Polarmax Corporation, Akron, Ohio

[21] Appl. No.: 588,669

[22] Filed: Mar. 12, 1984

[51] Int. Cl.[4] ..... H01Q 3/04

[52] U.S. Cl. ..... 343/766; 343/882; 248/183

[58] Field of Search ..... 343/878, 880, 882, 765, 343/766, 890, 892, 840; 248/519, 523, 533, 522, 180, 183, 184

[56] References Cited

U.S. PATENT DOCUMENTS

| | | | |
|---|---|---|---|
| 2,199,050 | 4/1940 | Jenkins | 343/882 |
| 3,076,964 | 2/1963 | Reinhold | 343/880 |
| 3,665,482 | 5/1972 | Cresswell | 343/765 |
| 3,886,559 | 5/1975 | Lanson et al. | 343/766 |
| 4,126,865 | 11/1978 | Longhurst et al. | 343/766 |
| 4,339,899 | 7/1982 | Klenk et al. | 52/157 |
| 4,454,515 | 6/1984 | Major et al. | 343/882 |
| 4,475,110 | 10/1984 | Hutchins | 343/766 |

FOREIGN PATENT DOCUMENTS

| | | | |
|---|---|---|---|
| 2725898 | 6/1977 | Fed. Rep. of Germany | 343/766 |
| 58-95406 | 6/1983 | Japan | 343/880 |

*Primary Examiner*—Eli Lieberman

*Assistant Examiner*—Michael C. Wimer

*Attorney, Agent, or Firm*—Oldham, Oldham & Weber Co.

[57] ABSTRACT

A motorized antenna mount for rotationally and pivotally supporting a satellite dish on a main vertical support pole. A base is adjustably mounted on the top of the support pole by a plurality of plumb bolts to compensate for any vertical misalignment of the pole. A motor housing is pivotally mounted on the base by a hinge and pair of curved pivot guide tracks. An electric motor is mounted in the motor housing and is connected to a drive gear through a gear reducer for rotating a turret which is mounted by a thrust bearing on turret mount attached to the top of the motor housing. The satellite dish is mounted on the end of a support arm which is pivotally adjustably mounted on the turret for declination angle control thereof. The turret has an internal arcuate-shaped gear track extending preferably 180° about a central opening formed in the interior of the turret and engageable with the motor for rotating the turret drive gear. A pair of set bolts are mounted on the turret to pivotally adjust the declination angle of the dish support arm. The improved mount provides both course and fine pivotal adjustment for the dish supporting arm and particularly provides a motorized drive for rotating the dish to any desired rotational position for accurately positioning the dish for a selected satellite.

8 Claims, 7 Drawing Figures

MOTORIZED ANTENNA MOUNT FOR SATELLITE DISH

TECHNICAL FIELD

The invention relates to television satellite receivers and in particular to the mounts for the satellite dish. More particularly the invention relates to an improved motorized mount for the satellite dish.

BACKGROUND ART

In the past several years the use of home satellite dishes located in the yards of home owners for receiving television signals from satellites orbiting the earth has increased in popularity. These satellite dishes reflect the television signals which are transmitted from the satellites which encircle the equator and bounce the microwaves to a center piece mounted above the dish called a focal point. This collected signal is then transferred by appropriate electronic equipment to the television set in the owner's home. There are presently a number of satellites encircling the equator in a space referred to as the "Clarke Belt" which is an area approximately 23,200 miles from earth. At this high orbit level a satellite will orbit at a speed equal to the earth's rotation and yet be stationery over one position at the equator. This is called a Geostationary orbit.

Today, most all television signals are beamed up to one or more of the satellites which changes the signals frequency and sends the signal back to earth where it is collected by these parabolic reflectors referred to as dishes. These dishes vary in size and structure depending upon their geographical location. A satellite is aimed at a particular portion of the earth called the foot print area with the satellite signal getting weaker and weaker as the area expands outwardly. Thus, the distance that the dish is located from the middle of the foot print area determines the size of the required dish.

There have been numerous types of supports on which the dishes are mounted which enable the various satellites to be tracked to provide for a greater variety of television reception. Since the elevation and east-west direction of each satellite is different, a mount that will swing from east to west a full 180° or more is desired while at the same time allowing for an arched swing across the sky that keeps the dish at 100% tracking of the Clarke Belt above the equator. Secondly, the mount must have sufficient strength for the support of the dish. These dishes can run up to 400 pounds of dead weight which when subjected to wind loading results in an extremely high stress factor on the various nuts, bolts and structural members of the mount.

It only takes a movement of less than a few inches to knock a dish off the satellite signal. Thus, if the mount is not extremely sturdy, even a small breeze can move the dish enough, due to its large surface area and resulting force moment, to remove or seriously disrupt the incoming signal. These mounts, in addition to providing a complete sweep from east to west without getting off track from the Clarke Belt, must provide means for plumb alignment. The main mounting post usually will be embedded in concrete or mounted on a concrete embedded pad and can move due to settling or ground conditions affected by frost, rain, snow, etc.

Certain types of mounts have provided a manually adjusted tracking mechanism by a screw jack which will extend and retract the actuator arm of the mount. Other types of motorized mounts have been used but do not provide the desired adjustment and alignment features desired for the aiming arm on which the satellite dish is mounted to achieve the most satisfactory results. Likewise, the motor and drive mechanism for the motorized mount constructions are affected by the weather causing operating and maintenance problems.

DISCLOSURE OF THE INVENTION

Objectives of the invention include providing an improved motorized antenna mount for a satellite dish in which the dish can be rotated at least 180° from east to west by an electric motor which is mounted within a completely protected housing which removes it from the harsh environment with which it may encounter. Another objective is to provide such an antenna in which adjustment means enable the declination angle of the dish aiming arm to be finely adjusted, and in which the motor housing is pivotally mounted on a base for presetting the dish and mounting arm to the desired angular direction prior to the fine adjustment setting thereof.

A further objective of the invention is to provide such an antenna mount in which the base on which the motor housing and aiming arm are mounted is adapted to rest upon the top of a main support pole which is embedded in the ground or mounted on a concrete pad, in which the mount base is provided with plumb controls for correcting for any vertical misalignment of the main mounting pole, and in which the plumb control is achieved by a plurality of bolts engageable with the top of the support pole. Still another objective is to provide such a mount in which an electric motor rotates the dish through a gear reducer and drive shaft, in which a drive gear is mounted on the drive shaft and is engaged with an arcuate gear track mounted on the inside of a turret, and in which the turret is mounted by a thrust bearing on top of a turret mount which supports the weight of the dish and aiming arm.

A further objective of the invention is to provide such an antenna mount in which the drive gear and gear track are concealed within a protective housing which removes them from the weather, and in which the aiming arm is pivotally adjustably mounted on top of the turret by a plurality of adjusting set bolts to provide a fine angular adjustment of the aiming arm in addition to the relative coarse adjustment achieved by the pivotal mounting of the motor housing on the mount base. Another objective is to provide such an antenna mount in which the arcuate gear track extends at least 180° or greater to a full 360° to provide unlimited rotation of the dish on the turret mount. A still further objective is to provide such an antenna mount which is formed of extremely rugged and available componets, which can be assembled relatively easily on a main support pole and maintain accurate alignment of the dish at all times, which removes the control components from the weather, and which solves the problems and satisfies needs existing in the art.

These objectives and advantages are obtained by the improved motorized antenna mount for satellite dishes of the invention, the general nature of which may be stated as including a base adapted to be mounted on an upper end of the support pole; arm means for supporting a satellite dish; motorized control means mounted on the base for rotating the arm means and supported satellite dish; and means pivotally adjustably mounting the support arm means with respect to the base.

BRIEF DESCRIPTION OF THE DRAWINGS

A preferred embodiment of the invention, illustrative of the best mode in which applicant has contemplated applying the principles, is set forth in the following description and shown in the drawings and is particularly and distinctly pointed out and set forth in the appended claims.

Similar numerals refer to similar parts throughout the drawings.

BEST MODE FOR CARRYING OUT THE INVENTION

Figure 1:
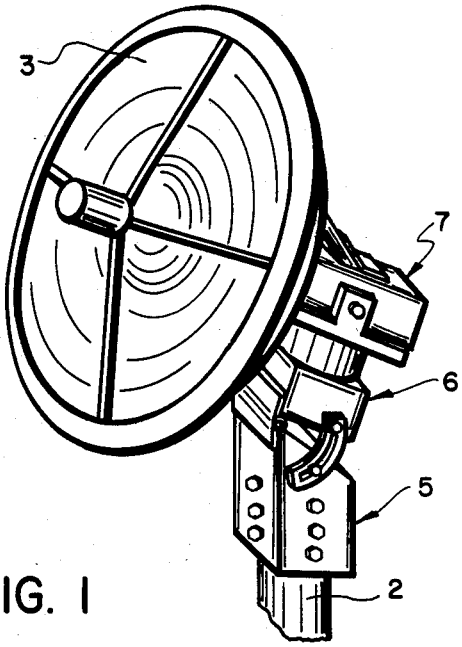
FIG. 1 is a fragmentary perspective view showing the improved motorized antenna mount with a satellite dish mounted thereon.

The improved motorized antenna mount is indicated generally at 1, and is shown in FIG. 1 mounted on top of a main support pole 2 with a satellite dish 3 being adjustably mounted on mount 1. The details of construction of improved mount 1 are shown particularly in FIG. 2. Mount 1 includes three main components or sections; namely, a base 5, a tracking pivot and motor drive unit 6, and a dish support aiming arm and declination control unit 7.

Figure 2:
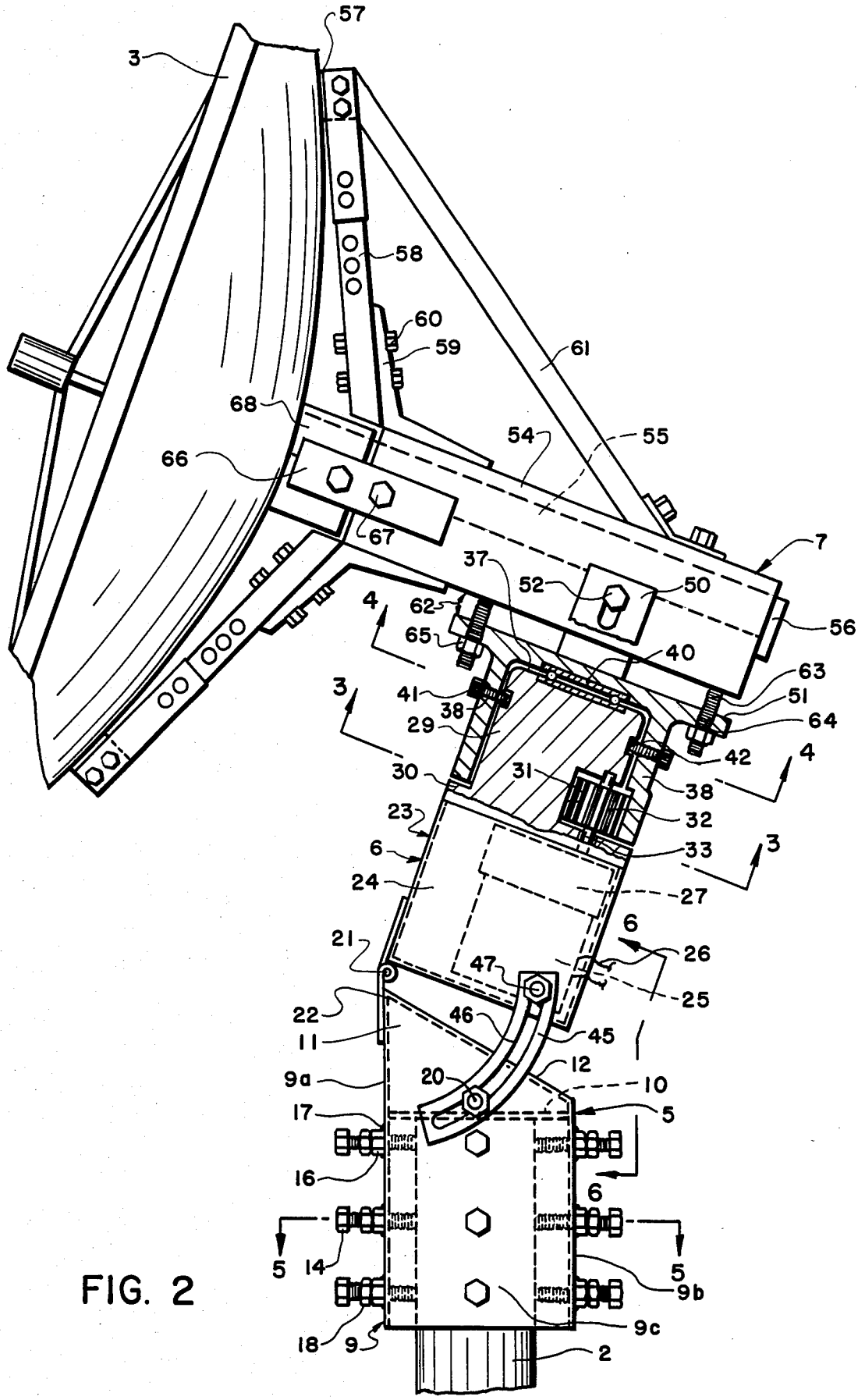
FIG. 2 is an enlarged sectional view of the improved antenna mount supporting a satellite dish shown mounted on top of a main supporting pole.

Main support pole 2 preferably is a round hollow member which will be embedded at its lower end in a concrete supporing base or bolted on a foundation (not shown). Pole 2 extends vertically upwardly from its base for mounting antenna mount 1 thereon as shown in FIG. 2. Antenna mount base 5 includes a housing 9 formed by a square boxed tubing having front and rear walls **9*a* and 9*b* and a pair of side walls 9*c*. A horizontal plate 10 is mounted within housing 9 for resting base 5 on top of pole 2. The upper end of base 5 is formed with a right angle triangular-shaped configuration having a sloped top wall 12 extending at up to a 70° angle with respect to front wall 9*a* and a 30° angle with respect to horizontal plate 10**.

Figure 5:
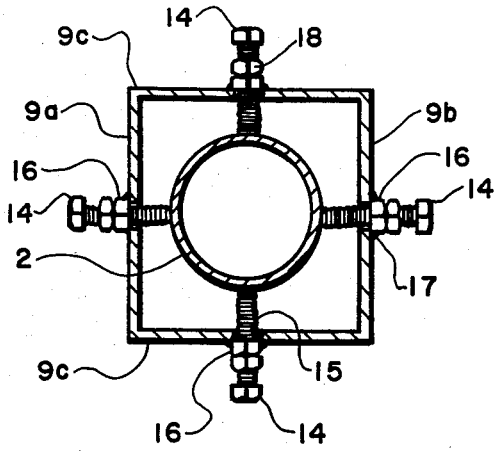
FIG. 5 is a sectional view taken on line 5—5, FIG. 2.
Figure 6:
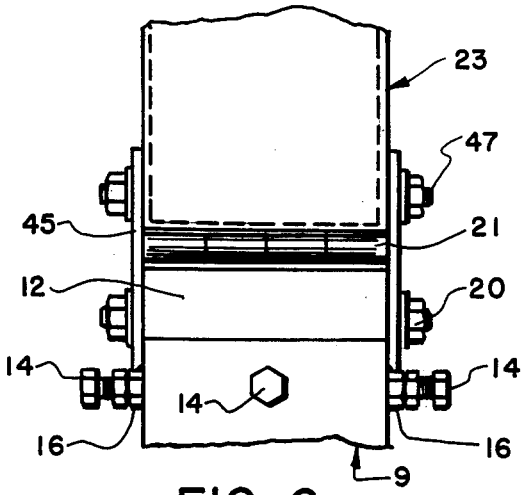
FIG. 6 is a fragmentary elevational view looking in the direction of arrows 6—6, FIG. 2.

In accordance with one of the feature of the invention, base 5 is adjustably mounted on the top of pole 2 by a plurality of plumb control bolts 14. Bolts 14 extend through holes 15 (FIG. 5) formed in housing walls **9*a*, 9*b* and 9*c*. Bolts 14 are adjustably mounted in nuts 16 which are attached by welds 17 to the outer surfaces of the housing walls. Twelve plumb control bolts 14 are shown in the drawings, three on each side of the housing spaced vertically above one another as shown in FIGS. 2 and 5. Plumb control bolts 14 enable antenna mount 1 to be adjusted for any minor misalignment of pole 2 with respect to a true vertical longitudinal axis. A locking nut 18 also is mounted on each bolt 14 for locking the control bolts in their adjusted position. A pair of locking bolts 20 are mounted on the upper triangular portion 11 of base 5 for locking the tracking pivot and motor drive unit 6** in a present adjusted position.

Drive unit 6 is mounted by a hinge 21 to front wall **9*a* of base 5 adjacent the vertex 22 thereof. Unit 6 includes a rectanular motor housing 23 preferably having a square configuration formed by four sidewalls 24. An electric motor 25 is mounted within housing 23 and connected to a source of electric power by leads 26. A gear reducer 27 is connected to the output shaft of motor 25**.

Figure 3:
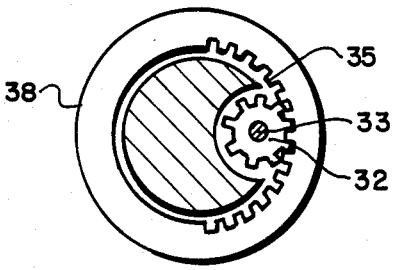
FIG. 3 is a sectional view taken on line 3—3, FIG. 2.
Figure 4:
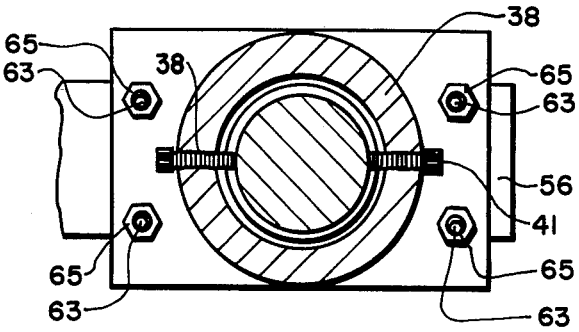
FIG. 4 is a fragmentary sectional view taken on line 4—4, FIG. 2.

A turret mount 29 preferably formed of a solid member is mounted on the upper end of motor housing 23 by a lower mounting flange 30. A concave recess 31 (FIG. 3) is formed in turret mount 29 for receiving a drive gear 32 therein. Gear 32 is rotatably mounted on the end of gear reduction shaft 33 and driven by motor 25. Drive gear 32 is engaged with an arcuate-shaped bevel gear track 35 or other suitable gear tracking formed on and extending approximately 180° or more around a cylindrical opening 36 formed within a turret 38. Turret 38 is rotatably supported on the top wall 37 of turret mount 29 by a thrust bearing 40.

Turret 38 is maintained on turret mount 29 by a pair of set bolts 41 which extend through threaded holes 34 formed in turret 38 and into an annular groove 42 formed in turret mount 29. Motor drive unit 6 is maintained in a preset pivotally mounted position on base 5 by a pair of adjustment arms 45. Adjustment arms 45 are formed with arcuate-shaped slide tracks 46 into which lower locking bolts 20 extend. The upper ends of a pair of arms 45 are attached to motor housing 23 on opposite sides thereof by a pair of locking bolts 47 or may be directly welded or fused to the housing.

Dish support arm and declination control unit 7 is pivotally adjustably mounted on the upper end of turret 38 by a pair of pivot brackets 50. Brackets 50 are formed integrally with or are attached to the top wall 51 of turret 38 and are secured by pivot bolts 52 to control unit 7. Control unit 7 includes an aiming arm 54 which is a square-shaped tube that contains a standard feed horn/LNA support tube 55 mounted therein and secured by an end latch 56. Dish 3 is firmly mounted on aiming arm 54 by a plurality of dish attachment brackets 57 mounted on the outer ends of dish support arms 58. Support arms 58 are attached to aiming arm 54 by a plurality of support brackets 59 and bolts 60. The declination angle indicated at 62 of aiming arm 54 is adjusted by a plurality of bolts 63 which are adjustably mounted in threaded holes 64 formed in top wall 51 of turret 38 and are secured in an adjusted position by nuts 65. A plurality of attachment straps 66 are connected by bolts 67 to aiming arm 54 and a rear mounting base 68 of dish 3. Additional reinforcing support arms 61 may extend between attachment brackets 57 and aiming arm 54 if desired to provide additional strength and rigidity to dish 3.

The operation of improved antenna mount 1 is easily seen by a review of FIG. 2. Mount 1 is mounted on vertical pole 2 and is adjusted by plumb bolts 14 to compensate for any vertical misalignment of pole 2. Next, tracking pivot and motor drive unit 6 is adjusted to the desired position by pivotal movement of motor housing 23 on hinge 21 and locking of bolts 20 and 47 of arms 45. Next, the angle of declination 62 is adjusted by adjustment bolts 63 pivotally moving aiming arm 54 and attached dish 3 to the desired declination angle.

Although arcuate bevel gear track 35 is shown extending only 180° within turret 38, it could extend up to 360° to provide for a complete rotation of turret 38 and correspondingly of dish 3 on turret mount 29. However, a 180° rotation has been found to be satisfactory for most all satellite dish mounting arrangements.

For most dish installations, the declination control angle is set at time of installation together with the angle of motor housing 23 with respect to base 5. After these two angles are set at a time of installation no further adjustments should be required unless the mount would be moved by wind or settling of the main support pole in the earth, or other causes. These angles which determine the direction of dish 3 are determined by the particular geographic location of improved mount 1. Furthermore, once plumb control bolts 14 have been set very little adjustment will be required unless support pole 2 becomes out of alignment due to settling of the earth or excess wind forces or other causes being exerted on the dish causing such misalignment.

The controls for motor 25 will usually be located within the users house adjacent the television set and may be of various types from single on-off switch enabling arm 54 and dish 3 to be rotated until stopped by the operator, or may be a programmed control which automatically stops the dish at the correct rotational position for each satellite.

Figure 7:
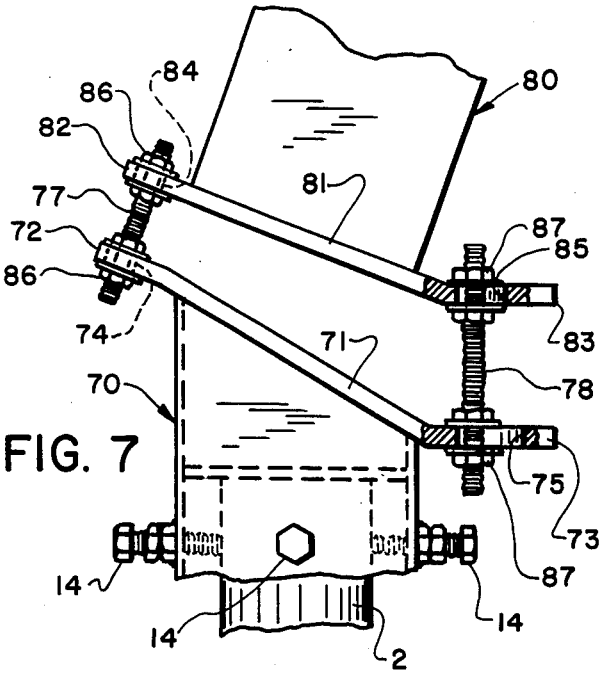
FIG. 7 is a fragmentary elevational view of a modified arrangement for attaching the improved mount on the main supporting pole.

A modified form of the pivotal connection of the motor housing with the base is shown in FIG. 7. A modified base indicated generally at 70, is adapted to be mounted on the top end of support pole 2 in the same manner as housing 9. Base 70 is provided with a top plate 71 which terminates in upper and lower outwardly extending end portions 72 and 73, respectively. End portions 72 and 73 are formed with slotted openings 74 and 75 through which mounting bolts 77 and 78 extend.

Motor housing 80 is mounted on a support plate 81 which terminates in end portions 82 and 83 which are formed with slots 84 and 85 through which bolts 77 and 78 extend. The angular position of the motor housing with respect to base 70 is adjusted by adjusting nuts 86 and 87 mounted on bolts 77 and 78, respectively, and engageable with base plate 71 and motor housing plate 81.

Accordingly, the improved motorized antenna mount 1 provides an extremely strong, durable and sturdy construction which maintains the motor and control features thereof out of the weather as well as the gear arrangement for rotatably mounting the aiming arm and supported dish. Improved antenna mount 1 also provides for a plurality of adjustments to compensate for any misalignment which may occur on the dish due to the weather conditions or other external forces exerted thereon.

Accordingly, the improved motorized antenna mount is simplified, provides an effective, safe, inexpensive and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved motorized antenna mount for satellite dish is constructed and used, the characteristics of the construction, and the advantageous, new and useful results obtained; the new and useful structures, devices, elements, arrangements, parts and combinations, are set forth in the appended claims.

What is claimed is:

1. An improved antenna mount for mounting a satellite dish on a vertical support pole, said mount including:

a base adapted to be mounted on an upper end of the support pole;

a plurality of bolts adjustably mounted on the base for engagement with the pole about the periphery thereof;

arm means for supporting a satellite dish;

motorized control means mounted on the base for rotating the arm means and supported satellite dish; including a housing containing an electric motor and a turret mount, a turret rotatably mounted on the turret mount and driven by the motor, and arm mounting means comprising a pivot bracket pivotally mounting the arm means on the turret and declination angle control bolts interposed between said arm means and said pivot bracket for maintaining the arm means in a pivotally adjusted position; and wherein said motor housing is pivotally mounted on the top of said base by a hinge and a pair of slotted adjustment arms adapted to be fixedly secured at one end to said base, and at another end to said motor housing, enabling the motor housing to be pivoted to a desired satellite tracking position.

2. The improved antenna mount defined in claim 1 in which the turret is formed with an arcuate gear track; and in which a drive gear is drivingly engaged with the gear track and is driven by the motor for rotating the turret with respect to the turret mount and motor housing.

3. The improved antenna mount defined in claim 2 in which the drive gear is connected to the motor through a gear reducer.

4. The improved antenna mount defined in claim 2 in which the gear track has an arcuate length of at least 180°.

5. The improved antenna mount defined in claim 1 in which the turret mount is a cylindrical shaped member mounted on the motor housing; in which a drive gear operatively connected to the motor is rotatably mounted within a concave recess formed in the turret mount; in which the turret is formed with a cylindrical central opening in which the turret mount is telescopically located; and in which the turret includes an internal gear track engaged with the drive gear for rotating said turret with respect to the turret mount.

6. The improved antenna mount defined in claim 5 in which the turret is rotatably mounted on the turret mount by a thrust bearing which also supports the turret on said turret mount.

7. The improved antenna mount defined in claim 6 in which the turret is maintained on the turret mount by retaining bolts which are mounted on the turret and extend into an annular groove formed in the periphery of the turret mount.

8. The improved antenna mount defined in claim 1 in which the base includes a housing telescopically mounted on and supported by the top of the vertical support pole.

* * * * *